US008161784B2

(12) United States Patent
Farnham

(10) Patent No.: US 8,161,784 B2
(45) Date of Patent: Apr. 24, 2012

(54) RAM FOR METAL CAN SHAPER

(76) Inventor: Timothy J. Farnham, Buffalo, NY (US)

( * ) Notice: Subject to any disclaimer, the term of this patent is extended or adjusted under 35 U.S.C. 154(b) by 0 days.

(21) Appl. No.: 13/116,280

(22) Filed: May 26, 2011

(65) Prior Publication Data

US 2011/0219850 A1 Sep. 15, 2011

Related U.S. Application Data

(63) Continuation of application No. 11/927,842, filed on Oct. 30, 2007, now abandoned.

(51) Int. Cl.
*B21D 51/26* (2006.01)
*B21J 13/04* (2006.01)

(52) U.S. Cl. ..... 72/94; 72/350; 72/456; 413/69

(58) Field of Classification Search ..... 72/94, 273, 72/433, 434, 456, 465.1, 466.8, 466.9, 347, 72/350; 413/69
See application file for complete search history.

(56) References Cited

U.S. PATENT DOCUMENTS 5,018,379 A * 5/1991 Shirai et al. ..... 72/354.6
6,199,420 B1 * 3/2001 Bartosch ..... 72/94

* cited by examiner

*Primary Examiner* — Debra Sullivan
(74) *Attorney, Agent, or Firm* — Jennifer Meredith, Esq.; Meredith & Keyhani, PLLC

(57) ABSTRACT

An apparatus for forming a two-piece can comprising: a cylindrical housing, the cylindrical housing having a first end and a second end; a first round bushing having a longitudinal rectangular bore and received in the first end; a second round bushing having a longitudinal rectangular bore and received in the second end; a substantially cornerless rectangular ram which slides in the longitudinal rectangular bore of the first round bushing and the longitudinal rectangular bore of the second round bushing; a spring interposed between the first round bushing and the second round bushing and surrounding the substantially rectangular ram.

14 Claims, 2 Drawing Sheets

RAM FOR METAL CAN SHAPER

This is a continuation of patent application Ser. No. 11/927,842 filed Oct. 30, 2007 now abandoned and entitled "Ram for Metal Can Shaper", the entire contents of which are incorporated herein by reference. The present invention is in relation to the machines used to form or "neck" the end of the can cylinder as part of a two piece can process.

Beverages are commonly served in aluminum and metal cans which are made at the pace of more than one million per day. They are generally formed from two pieces: a top (which generally has a tab for opening the beverage) which is generally affixed to a bottom after it is filled with a liquid substance such as a beer or soda. It is desirable to make the can as thin as possible, to reduce material and shipping costs. However, the can itself has to be strong enough to withstand both internal and external pressures. To do so the cylinder section of the can has many curves in its top and bottom to make the can more rigid and able to withstand the internal and external pressures created by internal gases and external axle loads created by stacking and handling. Necking down the top of the container requires less metal to form the top, further reducing the cost of the container and the expense to the end user.

There are many steps in forming or pulling the metal used in making a can of very thin metal—most commonly aluminum. The can starts as a sheet of metal that is stamped into a cup shape. The cup shape then goes to a body maker where it is pulled into a cylinder shape with the tapered domed bottom. From there it is then decorated with a design and then sent through an oven to cure the inks. A coating is then applied to the inside of the can. At this point the top of the cylinder is straight and round. It is at this point the top of the cylinder is then "necked down" to a smaller opening through a series of dies and pushers. These dies and pushers are held by a series of rams and cylinders that are attached to a turret, or carrier. Both cylinders oppose each other and the rams move in opposing directions at the same speed as the turrets turn pushing the can under pressure into the dies through numerous stations. The required shape is then formed. This process is commonly referred to as "necking" the cans. Also the cylinder and ram assemblies are referred as "necker cylinders".

The necker cylinders have many various components. The key components are the cylinder "bushing" and the ram or piston. The bushing and the ram, combined are currently a liquid tight cylinder with seals at opposing ends to prevent lubricant leaks while the piston moves back and forth at high speeds during the necking process. The piston is a round cylinder that rides in a brass or steel bushing. One end of the piston has two wheels that follow a rail on a stationary cam that has a curve in the rail track to make the piston move back and forth as the turret turns. To prevent the round piston from spinning in the bushing, there is an internal key and keyway that also allows the cam followers to stay indexed to the rail of the cam and prevents centrifugal force from turning the piston during high speed operation.

These old style ram assemblies are lubricated by hand in a very time consuming process that required regular line shut down time to assure the pistons are properly lubricated. Newer machines have automatic or continuous lubrication to the ram assemblies by the means of grease tubes to each ram. This tube lubing process has continual problems because the tubes are connected to special couplings to accommodate the spinning of the turrets. These couplings wear out and allow grease to contaminate thousands of cans before the problem is detected. Once detected the line must be shut down for long durations until the problem is located among the many rams and then repaired. Another problem is the oil seals at the end of the bushings. These oil seals wear out and cause contamination as well and the shut down time is even greater. Hundreds of cylinders must be inspected to locate the problem. It must then be removed and replaced with a rebuilt assembly.

The internal key and key way is also problematic. They often break down or loosen, destroying the ram assembly and commonly the oil seals as well. Production is again interrupted and damage to the cam and the machine must be repaired.

These machines typically produce 2500 cans per minute. It is not uncommon for the machines to malfunction for 15 to 20 minutes before production can be halted. When a cylinder malfunctions the cans are contaminated and must be scrapped. The shut down time to repair these cylinders costs manufacturers $10,000 or more per hour in lost revenues. Most facilities maintain a complete extra set of these cylinders which are being rebuilt and made ready for change-over either monthly or quarterly for every machine. This is a very time consuming process and very costly as well due to the 8 to 16 hours required to replace these cylinders. These shut downs cost on average more than $100,000.00 each time in loss of production plus the cost of rebuilding. The weight is another inherent problem. These cylinder assemblies can weigh in excess of 20 pounds each requiring a tremendous amount of energy to turn the turrets due to the fact that the assemblies are made of brass and steel.

Numerous attempts have been made to try and solve these problems within the art. One design is the square ram assembly, which tries to eliminate the lubrication problems and key way and weight as well. This design uses a rectangular ram and a solid bushing with a rectangular opening to accept the ram. Both made of aluminum to address the weight issue and by applying a Teflon-ceramic coating on the friction surfaces to address the lubrication problem. This solution only works for a short period of time before the coating breaks down and fails requiring rebuild. Also the tooling adaptors are added to the ram because it is made of soft aluminum which breaks and wears rapidly. This only increases the number of assembly parts and cost of such parts. The rectangular ram does address the key way issue but the points in the corners cause pinch points and wear edges as well. This only creates another inherent problem or break down starting point, thus not a solid solution.

Accordingly, it is the object of the present invention to provide a lubricant free assembly, with increased life span, less drag and less friction.

These and other features, aspects and advantages of the present invention will become better understood with reference to the following description and claims.

SUMMARY OF THE INVENTION

The present invention relates generally to ram assemblies, and in particular to a lubricant-free, low drag, low friction ram assembly with increased life span.

According to one embodiment, an apparatus for forming a two-piece can is provided, the apparatus comprising: a cylindrical housing, the cylindrical housing having a first end and a second end; a first round bushing having a longitudinal rectangular bore and received in the first end; a second round bushing having a longitudinal rectangular bore and received in the second end; a substantially cornerless rectangular ram which slides in the longitudinal rectangular bore of the first round bushing and the longitudinal rectangular bore of the second round bushing; a spring interposed between the first round bushing and the second round bushing and surrounding the substantially rectangular ram.

According to another embodiment, an apparatus for forming a two-piece can is provided, the apparatus comprising: a cylindrical housing, the cylindrical housing having a first end and a second end; a first round bushing having a longitudinal rectangular bore and received in the first end; a second round bushing having a longitudinal rectangular bore and received in the second end; a cylindrical cavity formed between the first round bushing and the second round bushing and surrounded by the cylindrical housing; a cornerless substantially rectangular ram which slides in the longitudinal rectangular bore of the first round bushing, the longitudinal rectangular bore of the second round bushing and the cylindrical cavity; a spring in the cylindrical cavity and between the first round bushing and the second round bushing and surrounding the substantially rectangular ram; and a retaining means in communication with the spring for maintaining the spring in a portion of the cylindrical cavity.

These and other features, aspects and advantages of the present invention will become better understood with reference to the following description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
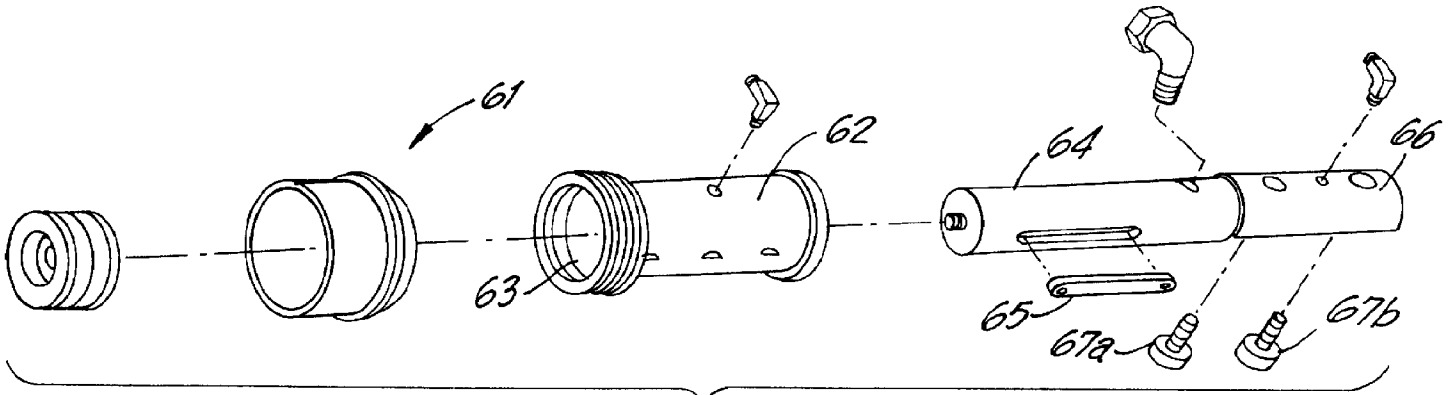
PRIOR ART FIG.1
FIG. 1 is a prior art ram assembly.
Figure 2:
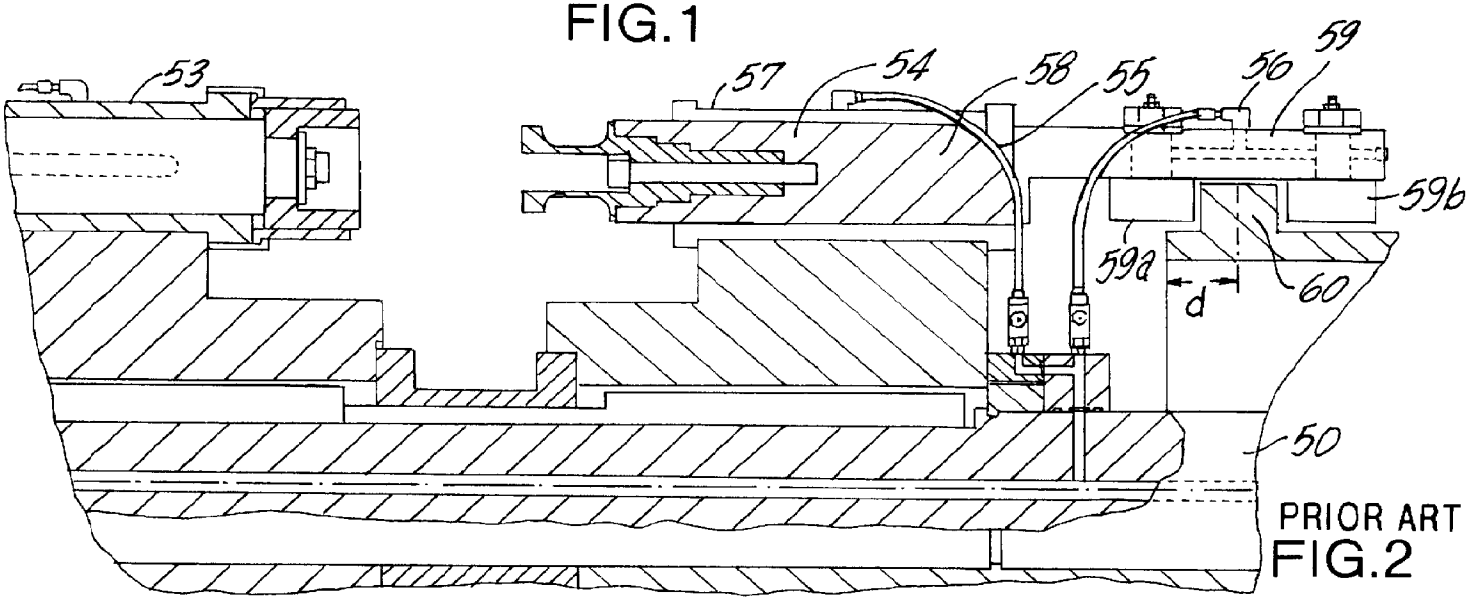
PRIOR ART FIG.2
FIG. 2 is a prior art ram assembly.
Figure 3:
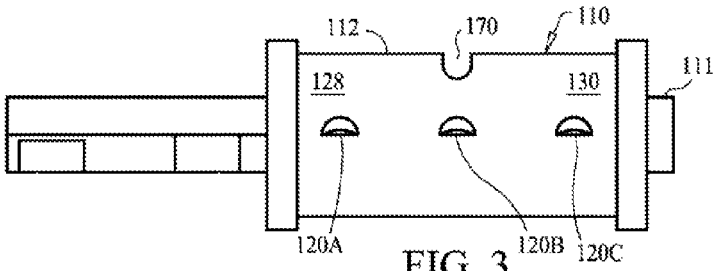
FIG. 3 depicts the present invention.

FIG. 1 depicts a typical ram assembly 61. The bushing 62 has a round bore 63 in which the ram slides in. The ram 64 has a key 65 that slides in a key way (not shown) The tail portion 66 has two cam followers (67*a* and 67*b*). FIG. 2 depicts a cross sectional view of a portion of a BELVAC metal can forming machine. A central shaft 50 is motor driven and rotates. The turrets are fixed to the shaft and rotate with it. Series of rams are mounted to the turrets. A series of lubrication tubes 55 leads to a lubrication nozzles 56. The ram assembly 54 includes a fixed bushing 57 having a round bore and a ram 58. The tail portion 59 of the ram 58 carries two cam followers 59*a* 59*b*. The cam followers 59*a* an 59*b* are mounted to ride on the sides of the fixed cam 60 which is an elongated protrusion forming a circle.

Figure 4:
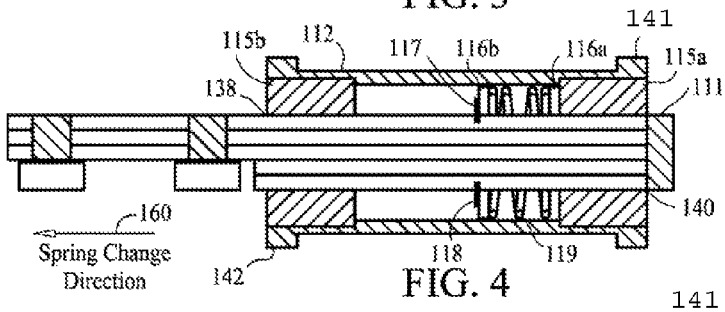
FIG. 4 depicts the present invention.
Figure 5:
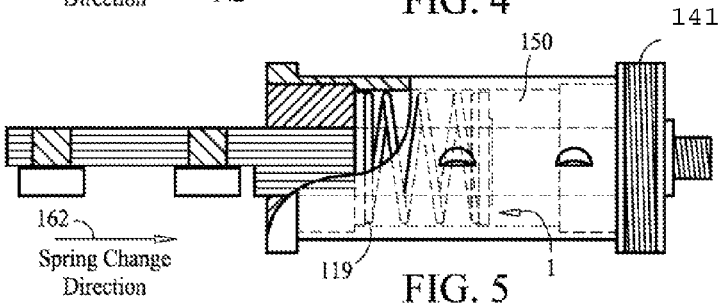
FIG. 5 depicts the present invention.

FIGS. 3-6 depict a ram assembly according to the present invention. As shown the apparatus has: a cylindrical housing (112), cylindrical housing having a first end (128) and a second end (130); a first round bushing (115*b*) having a longitudinal rectangular bore (138) and received in the first end (128); a second round bushing (115*a*) having a longitudinal rectangular bore (140) and received in the second end (130); a substantially rectangular ram (111) which slides in the longitudinal rectangular bore (138) of the first round bushing (115*b*) and the longitudinal rectangular bore (140) of the second round bushing (115*a*); a spring (119) interposed between the first round bushing (115*b*) and the second round bushing (115*a*) and surrounding the substantially rectangular ram (111). The cylindrical housing (112) holds two solid bearings or bushings (115*a* and 115*b*) made of composite material and does not require lubricant between the ram and the bearing e.g.; "phenolic". The housing is designed so that the bushings as well as the spring assembly may be replaced. There may also be an integral attachment means (e.g. 141, 142) along the outside of at least one of first end (128) and the second end (130). The first round bushing (115*b*) may be attached to the inside of the first end (128) of the cylindrical housing 112. It may be mechanically attached (screwed in), attached by an adhesive, such as green Ioctite™, or any other attachment means. Green Ioctite™ is an extremely low viscosity compound that is used to "fit" a shaft to a bearing. Since the compound has such low viscosity, capillary action wicks the solution between the shaft and the inner race of the bearing. After a period of time (approximately 15 minutes), the adhesive cements itself under an anaerobic reaction. The second round bushing (115*a*) may be attached in a similar manner, typically being slightly smaller than the inside of the cylindrical housing and fitting snugly therein. As shown in FIG. 5, the integral attachment means is a threaded flange for attaching the apparatus to the assembly.

Figure 6:
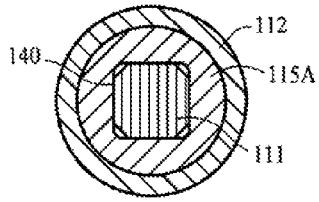
FIG. 6 depicts the present invention.

One of the intended advantages of the present invention is to reduce drag and friction at all points in the assembly. This is accomplished through a number of different ways. The assembly having a first round bushing (115*b*) and a second round bushing (115*a*) with a cylindrical cavity (150) between reduces the drag on the substantially rectangular ram by providing less contact. Another way in which the drag is reduced, is by shaving off the four corners of the substantially rectangular ram, to make an octagonal ram (111), as shown in FIG. 6. It should be understood that because the corners are removed, there is much less contact and therefore much less drag and wear and tear on the ram. While the ram (111) is referred to as octagonal, it should be understood that it is still substantially rectangular, as can be seen in FIG. 6, because very small corners have been removed. The corners may also just be slightly rounded, or "chamfered", resulting in a cornerless rectangular shape (not technically an octagon). Rounded corners would eliminate corner pinching and wear point edges. Neither the steel ram nor the bushing require any type of coating or lubricant. This design keeps the cam followers indexed to the cam during rotation of the turret/carrier to counteract centrifugal force. It also eliminates the need for a key and key way.

There may be a common groove (118) formed in the substantially rectangular ram (111). This may be particularly useful to receive a retaining means, such as a retaining clip (117). The retaining means (117) would, according to a preferred embodiment, surround at least a portion of the substantially rectangular ram (111) may secure a washer (116*b* in FIGS. 4 and 116*a* in FIG. 5) and be in communication with the spring. This is an extremely valuable aspect of the present invention, because it can effectively double the life span of the apparatus. The spring assembly charges the ram bi-directionally, so that the cam followers will ride and wear only one side of the rail at a time depending on which way the ram is charged. The opening in the outer housing allows the operator to change the position of the spring retainer thus changing the charge direction. This will double the life of the cam and allows the use of only one cam follower which provides continuous contact between the cam follower and the cam. This prevents creasing during the metal forming process known as "necking" caused by back lash between the cam and the cam follower.

The steel ram may be charged bi-directionally to permit the use of a single cam follower depending on the position of the retaining clip in the common groove (118) in the ram (111). For example, FIG. 4 shows the spring (119) on the right side and a spring charge direction (160). FIG. 5 shows the spring (119) moved to the left side and a spring charge direction (162). The retaining clip (117) may be removed through cylindrical cavity (170) in a top portion of the generally cylindrical housing (110) and the spring (119) moved from side to side. The opening (170) as shown is a small opening in the center. There may also be an opening that runs the entire length of the cylindrical housing (110) and is parallel to the ram (111). This may provide would provide easy maintenance and would not depart from the opening as claimed.

The present invention provides many novel components in the ram assembly. The separate outer housing (110) made of light weight alloy, e.g., aluminum, is reusable time and time again and adapts to the common carrier or turret. The housing (110) also allows for the use of two replaceable non lubricated or coated bushings as well as the replaceable spring (119) assembly and allows operator to change the direction of the spring charge on the piston easily via the opening (170) in the top of the housing (110). The opening (170) in the housing (110) also allows the tool and dies to breathe during motion. The bushings (e.g. 115*a* and 115*b*) are made of a long lasting durable material such as lien phenol or high comp and match well with a polished steel ram for long life. These materials are proven in use in a similar application in can production line and the bushing and the steel shaft needed not be replaced after years of running without any type of lubrication. Some are still in operation since 1995. The bushings (e.g. 115*a* and 115*b*) are also replaceable together or individually when wear does occur and also act as retaining surface for the spring (119) assembly to push against as a leverage surface. Using two individual bushings (e.g. 115*a* and 115*b*) at each end of the outer housing allows much greater precision in the tolerances in machining the opening due to the shallow depth of the bushing unlike the solid deep one piece bushing. This provides more concentricity of all the parts moving along the invisible axis of the ram assembly there for providing consistency in the necking process. Plus the bushings are light weight and much smaller than solid one piece bushing bodies currently in used today.

The novel spring assembly allows the steel ram to be charge bi-directionally to permit the use of a signal cam follower depending on the position or the retaining clip in the common grove in the ram. With this constant contact between the cam follower and the cam provided by the springs charge prevents creasing in the necking of the can. The spring assembly also allows the use of one side of the cam rail at a time there for doubling the life of the cam and less rejects from creasing.

The ram is novel by its unique geometry, an octagon, which is elongated on four sides to prevent corner pinching and wear edges found in square rams. The ram also has a common grove in it for a spring retaining clip that allows the ram to be charged and only require one cam follower to move back and forth. The ram is made of a durable alloy steel and accepts the current tooling used in the industry today. The ram is much smaller in size so there for much lighter than the typical round ram used today. The ram's unique geometry also provides indexing for the cam follower and eliminates the need for a key and key way to prevent rotation caused by centrifugal force. Also the unique geometry provides four surface to surface friction points between the ram and the bushing unlike a square or rectangle that have eight, four sides and four corners or points that make contact.

It should be understood that the foregoing relates to preferred embodiments of the invention and that modifications may be made without departing from the spirit and scope of the invention as set forth in the following claims.

I claim:

1. An apparatus for forming a two-piece can, said apparatus comprising:

a cylindrical housing, said cylindrical housing having a first end and a second end;

a first round bushing having a longitudinal rectangular bore and received in said first end of said cylindrical housing;

a second round bushing having a longitudinal rectangular bore and received in said second end of cylindrical housing;

a substantially cornerless rectangular ram which slides in said longitudinal rectangular bore of said first round bushing and said longitudinal rectangular bore of said second round bushing;

a grove in said substantially cornerless rectangular ram for receiving at least one retaining means;

a spring interposed between said first round bushing and said second round bushing and surrounding said substantially rectangular ram and retained by said retaining means.

2. An apparatus as in claim 1, further comprising at least one integral attachment means, wherein said integral attachment means is along the outside of at least one of said first end and said second end.

3. An apparatus as in claim 1, wherein said substantially cornerless rectangular ram is an octagonal ram.

4. An apparatus as in claim 1, further comprising an opening in a top portion of said generally cylindrical housing.

5. An apparatus as in claim 1, further comprising at least one washer surrounding said substantially cornerless rectangular ram and in communication with said spring.

6. An apparatus as in claim 1, wherein said at least one retaining means substantially surrounding said substantially cornerless rectangular ram.

7. An apparatus as in claim 1, wherein at least one of said first round bushing and said second round bushing is integrally formed from said cylindrical housing.

8. An apparatus for forming a two-piece can, said apparatus comprising:

a cylindrical housing, said cylindrical housing having a first end and a second end;

a first round bushing having a longitudinal rectangular bore and received in said first end;

a second round bushing having a longitudinal rectangular bore and received in said second end;

a cylindrical cavity formed between said first round bushing and said second round bushing and surrounded by said cylindrical housing;

a cornerless substantially rectangular ram which slides in said longitudinal rectangular bore of said first round bushing, said longitudinal rectangular bore of said second round bushing and said cylindrical cavity;

a spring in said cylindrical cavity and between said first round bushing and said second round bushing and surrounding said substantially rectangular ram; and a grove in said substantially cornerless rectangular ram for receiving at least one retaining means in communication with said spring for maintaining said spring in a portion of said cylindrical cavity.

9. An apparatus as in claim 8, further comprising at least one integral attachment means, wherein said integral attachment means is along the outside of at least one of said first end and said second end.

10. An apparatus as in claim 8, wherein said substantially rectangular ram is an octagonal ram.

11. An apparatus as in claim 8, further comprising an opening in a top portion of said generally cylindrical housing.

12. An apparatus as in claim 8, further comprising at least one washer surrounding said substantially rectangular ram and in communication with said spring.

13. An apparatus as in claim 8, wherein said at least one retaining means substantially surrounds said substantially rectangular ram.

14. An apparatus as in claim 8, wherein at least one of said first round bushing and said second round bushing is integrally formed from said cylindrical housing.

* * * * *